United States Patent [19]

Elliott, Jr.

[11] Patent Number: 4,520,710

[45] Date of Patent: Jun. 4, 1985

[54] DRUM AND CYMBALS PEDALS ASSEMBLY

[76] Inventor: Francis J. J. Elliott, Jr., 300 S. Forest Ave., Apt. 6, Liberty, Mo. 64068

[21] Appl. No.: 179,872

[22] Filed: Aug. 18, 1980

Related U.S. Application Data

[63] Continuation-in-part of Ser. No. 60,132, Jul. 24, 1979.

[51] Int. Cl.[3] ..... G10D 13/02; G10D 13/06

[52] U.S. Cl. ..... 84/422 R

[58] Field of Search ..... 84/422 R, 422 C, 422 H

[56] References Cited

U.S. PATENT DOCUMENTS

| | | | |
|---|---|---|---|
| 1,031,598 | 7/1912 | Tobias | 84/422 C |
| 1,305,942 | 6/1919 | Smith | 84/422 |
| 1,445,650 | 2/1923 | Strupe | 84/422 C |
| 1,479,376 | 1/1924 | Danly | 84/422 C |
| 2,581,515 | 1/1952 | Christian | 84/422 R |
| 2,784,635 | 3/1957 | Troppe | 84/422 |
| 3,055,254 | 9/1962 | Haviland | 84/422 |
| 3,147,661 | 9/1964 | Padera | 84/422 H |
| 3,797,356 | 3/1974 | Duffy et al. | 84/422 R |
| 4,028,984 | 6/1977 | Sanchez | 84/422 C |
| 4,048,896 | 9/1977 | Calato | 84/422 R |
| 4,134,325 | 1/1979 | Loftus | 84/422 R |
| 4,186,644 | 2/1980 | Kurosaki | 84/422 R |
| 4,216,696 | 8/1980 | Alexis | 84/422 R |
| 4,235,146 | 11/1980 | Purdy | 84/422 R |

FOREIGN PATENT DOCUMENTS

| | | | |
|---|---|---|---|
| 649914 | 2/1951 | United Kingdom | 84/422 H |

*Primary Examiner*—A. A. Mathews

*Attorney, Agent, or Firm*—Shoemaker and Mattare, Ltd.

[57] ABSTRACT

Two pedal assemblies, for drum and cymbals, mounted together or usable separately.

Both pedals use tension cable in a triangular drive coupling, have an invertible treadle, symmetrical frame and drive parts, non-slip base, portable modular construction, treadle detent, heel stop and footrest, and provide for adjustment of treadle angle and escapement means, and also provide inherent escapement by suspension.

The drum pedal assembly facilitates supplementary escapements, provides a drum stand and adjustment means for mechanical advantage, effective beater length and angle, and uses static axle and single beater cantalever bearing portion with centering and lubrication spacers, and perforated strap beater clamp.

The cymbals pedal assembly facilitates supplementary escapement, includes means to operate more than one pair of cymbals without support obstruction and function upwardly or downwardly to close the cymbal pairs together, provides adjustment means for cymbal height, spacing, and tilt, and uses roller-drive, locking movable cymbal clamp, adjustable stationary cymbal clamps and stops, drive rod detent, drive rod guide, drive rod with tab catches, triangular drive guide, and perforated strap drive guide clamp.

17 Claims, 5 Drawing Figures

DRUM AND CYMBALS PEDALS ASSEMBLY

Continuation in part of application Ser. No. 60132, Filing Date 7/24/79.

BACKGROUND OF THE INVENTION

The present invention consists of a group of novel parts which can be combined and fastened to make a novel drum and cymbals pedals assembly. It is for mechanical assistance means to musical performance on a drum and/or cymbals.

Some factors and criteria considered important to the inventor while developing this invention: temporally consistantly smooth and stable operation under various loads and conditions; firstsaid factors and criteria versus minimum dynamic inertia; friction, maximum dynamic range and minimum undesirable oscillation; versatility; ease and maximum range of adjustability and adaptability; size, shape, gripping, calibrative, and rectifying qualities and their inter- and co-relationships; minimum wind resistance; ease and simplicity of manufacture, operation, maintenance, and user-serviceable modular construction; portability; simplification of escapement means; posture and fatigue; maximum non-dynamic inertia versus weight; attachability; usefulness in conjunction with nearby or contiguous musical instruments and/or stands; safety from breaking drumheads; overall utility versus cost; ability to pedipulate more than one pair of cymbals with a single treadle; and esthetic beauty.

BRIEF SUMMARY OF THE INVENTION

The present invention basically consists of two pedal assemblies, one for beating a drum, and one for operating cymbals, mounted together in one assembly. The drum pedal assembly, including a stand for mounting a drum, and the cymbals pedal assembly, including means to operate more than one pair of cymbals, can be used together or separately.

A bass drum can be easily and rapidly fixed to the drum pedal assembly by means of common hook-ended elastic cords, inconvenience to performer, drum and situation; such cords may be either attached around and hooked to various portions of the drum pedal assembly and the drum. If preferred, fastening means other than those described herein may be used in lieu of such means, which are here used for descriptive simplicity.

Clamp means fix the drum beater to the drum pedal assembly and the cymbals and drive guide in the cymbals pedal assembly.

Both pedal assemblies provide inherent escapement, and can be easily provided with supplementary escapements for faster action.

With reference to the drum pedal assembly and one configuration of the cymbals pedal assembly, the drum beater and the lower of each cymbal pair are movably suspended; and thereby with gravity can act toward their escapement, from the drumhead and the upper of each cymbal pair, respectively, after initiation of an operating cycle.

The cymbals pedal assembly can be configured to move either the lower or the upper cymbal in every pair of cymbals fixed to it; said upper cymbals can remain essentially stationary, facilitating performance upon it or them by means other than pedipulation.

Treadle assemblies are invertible, facilitating the use of different foot-contacting surfaces.

Primary and secondary adjustments of all essential derivative mechanical advantage potentials is provided for in the drum pedal assembly.

Base, structural frame, and drive members are fully symmetrical, simplifying their manufacture, assembly, and disassembly, as well as the interconnection of assemblies to each other; they can be connected at either side.

It will be understood by those familiar with the art that the present invention can transfer and transform motion of foot power to cymbals and to a drum beater and upon a drumhead in new ways, by means of new components which can be manufactured using modern techniques and expertise with modern materials.

The broad purpose of this invention is to improve the state of the art of drum beaters and accessories, for the benefit of those concerned there-with, including the inventor.

BRIEF DESCRIPTION OF DRAWING VIEWS

Figure 4:
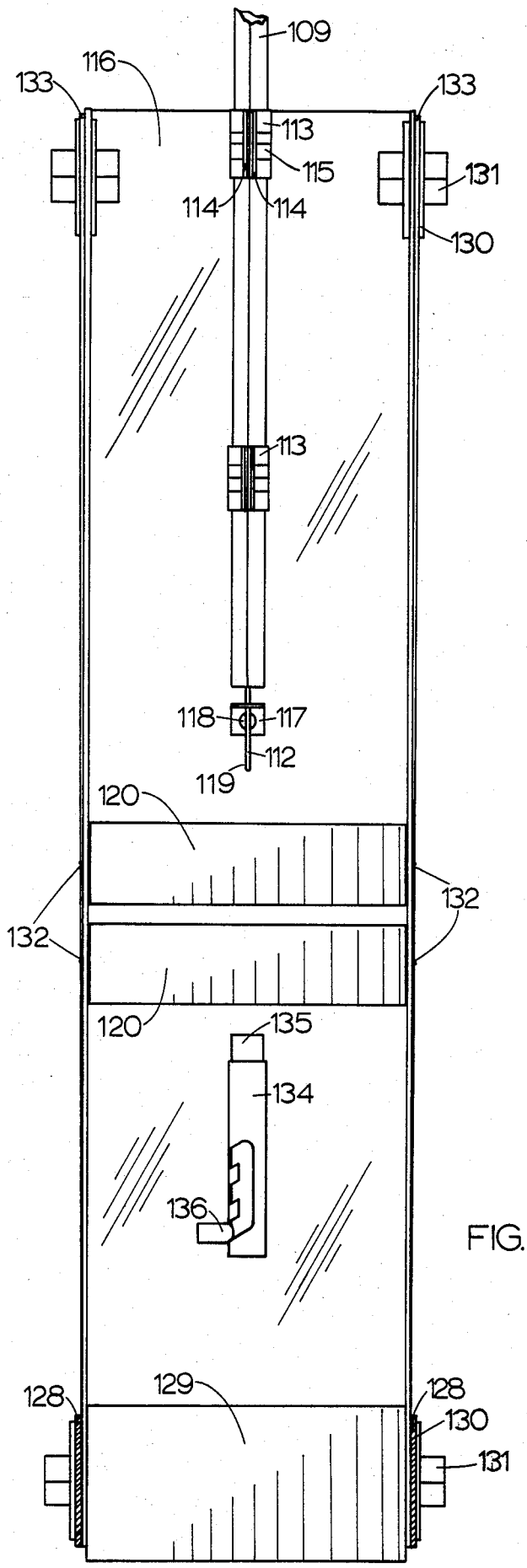
Figure 5:
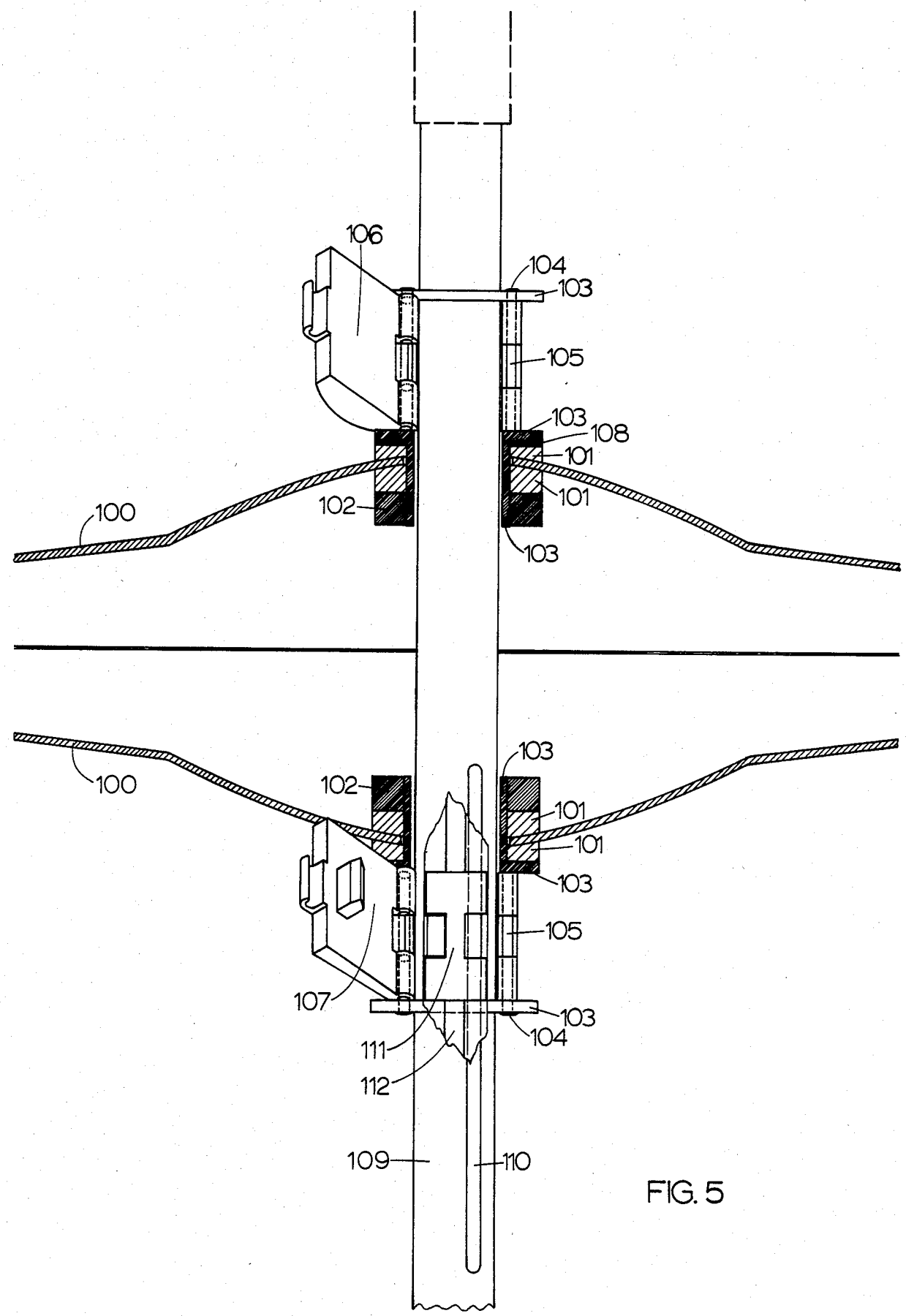

FIG. 4 is an enlarged detail view of a portion of the cymbals pedal assembly part of the invention, being a heel-end elevation, shown with portions of its structural frame and drive members cut-away and without parts normally mounted thereto, and without a tension cable and supplementary escapement means; and FIG. 5 is an enlarged detail view of an upper portion of the cymbals pedal assembly part of the invention, shown with portions of cymbals, cymbal clamps, and drive guide cut-away, in elevation, excepting two cymbal clamp members, which are illustrated isometrically.

DETAILED DESCRIPTION

Figure 1:
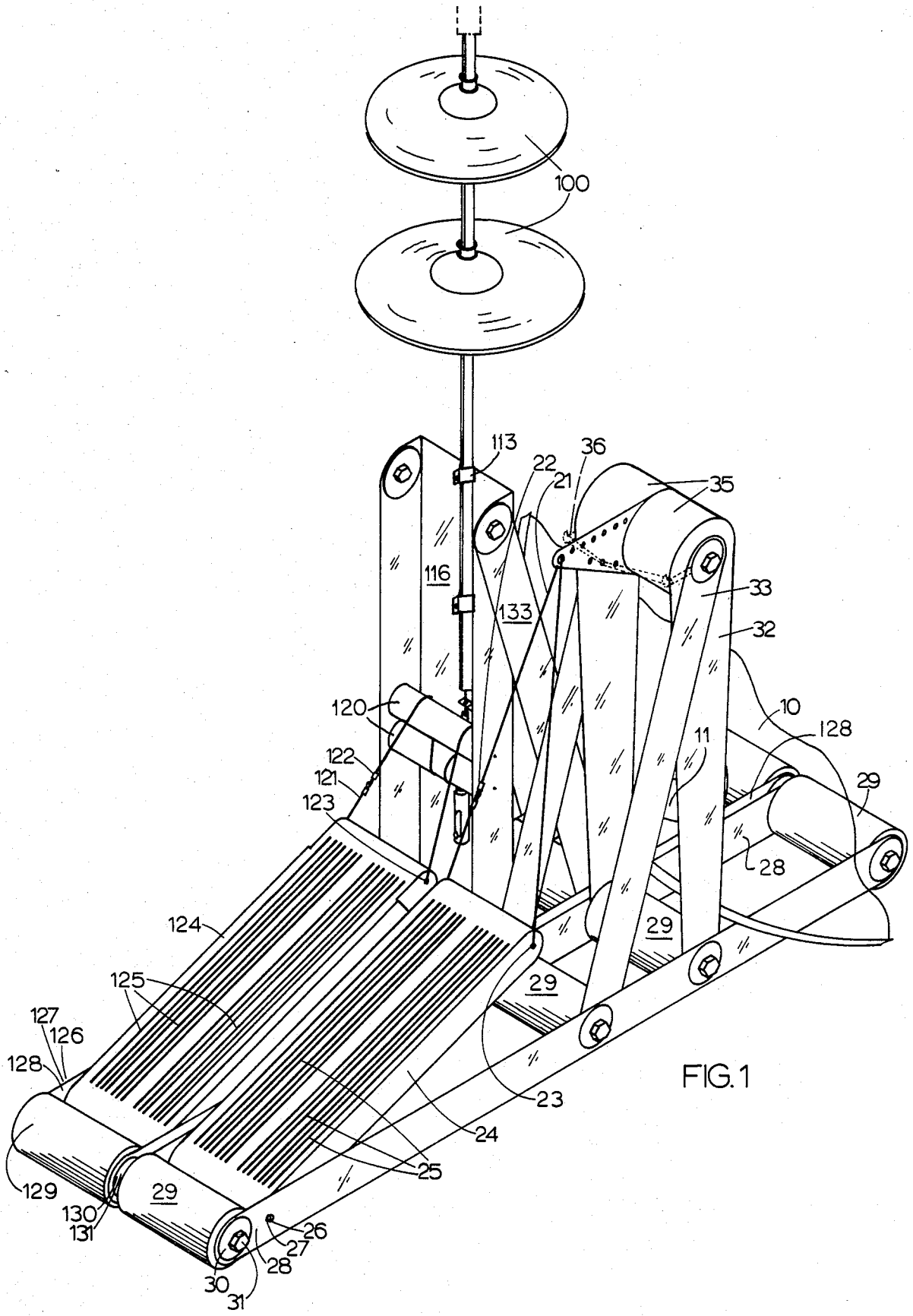
FIG. 1 is an isometric view of the present inventon, taken from its right side looking down.
Figure 2:
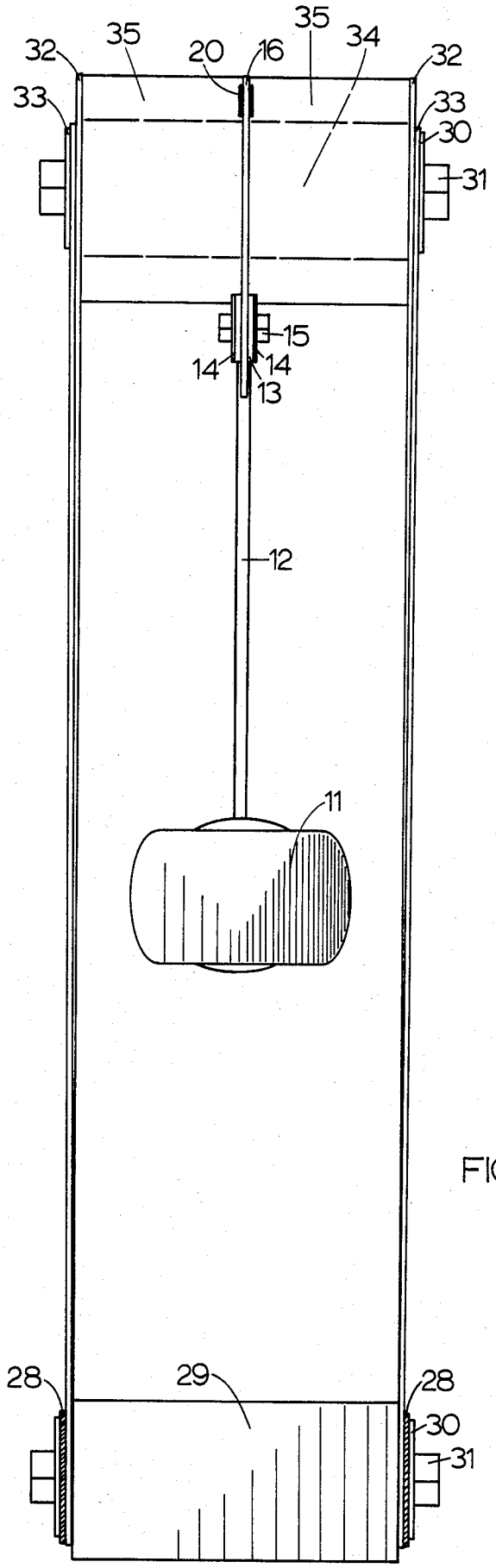
FIG. 2 is an enlarged detail view of a portion of the drum pedal assembly part of the invention, being a heel-end elevation, shown with a portion of its structural frame cut-away and without parts normally mounted thereto, and without a tension cable and supplementary escapement means.
Figure 3:
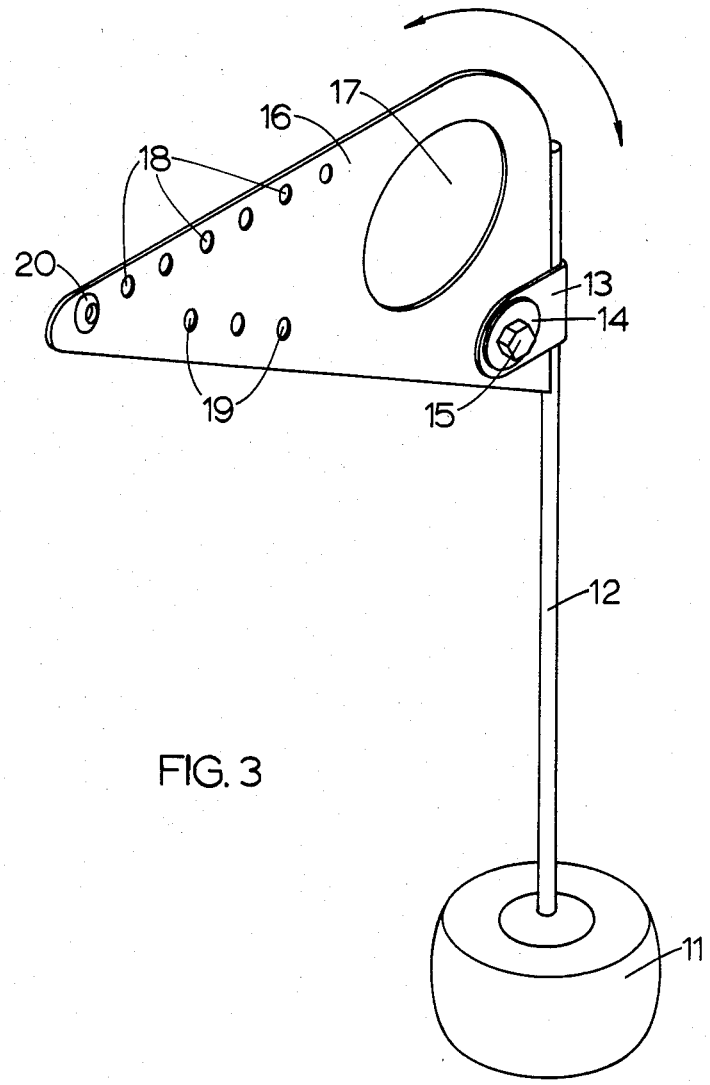
FIG. 3 is an enlarged isometric detail view of the beater cantalever assembly part of my invention, shown with an arrow indicating rotational potentials.

The following description refers to drawing FIGS. 1, 2, and 3. Beater head 11 is attached to beater stem 12, which is clamped, by means of being constricted by perforated strap 13, compression washer 14, and fastener means 15 carried by beater cantalever 16, to beater cantalever 16.

Beater cantalever 16 is rotatably mounted to static axle 34, by means of opening 17 bearing against static axle 34, illustrated in phantom.

Cant of beater cantalever 16 is changeble by means of mechanical force applied to a selection of drive openings 18, either of the two edges which meet at the most tapered end of beater cantalever 16, and secondary escapement openings 19, from, respectively, treadle 24 and through tension cable 21, beater head 11 and ternary escapement means, not illustrated, and through beater stem 12, and secondary escapement means 36, illustrated in phantom.

A choice of three beater stem 12/beater cantalever 16 configurations, seven drive openings 18, three secondary escapement openings 19, and beater stem 12 lengths, is provided for adaptability to preferred operating characteristics. Since beater stem 12 can be clamped to either of the two edges which meet at the most tapered end of beater cantalever 16, and since beater cantalever 16 can be mounted to static axle 34 as shown in FIG. 1, or having been firstly removed and rotated to inversion on static axle 34 and secondly remounted, and also since, in the lattermost case, drive openings 18 can function as secondary escapement openings 19 and vice versa, three practical configurations are possible. In use, this facilitates characteristically different beater cantalever 16 rotational potential derivatives, due to differing mechanical advantages of drive openings 18, beater stem 12, and secondary escapement means openings 19; and also facilitates different timbral effects, as beater head 11 can impinge on drumhead 10 at different angles.

Beater head 11 is suspended from its mounting, rather than superposed. This first inherent escapement, in conjunction with sufficient beater stem 12 length and beater head 11 weight, can countervail the effective weight of treadle 24, decreasing the need for escapement potential, such as that developed by spring tensioning. However, for faster action, secondary escapement openings 19 are provided as potential to act against preferred secondary escapement means. An embodiment of secondary escapement means 36 is pictured in phantom. Such means as an elastic band mounted to fixtures such as hooks fastened by frame bolts 31 near the apex formed by frame members 32 and 33, or mounted to similar fixtures fastened lower on frame members 32, can act, against secondary escapement openings 19, or directly against beater stem 12, respectively, to return the drum beater from the drumhead.

Whatever secondary and/or ternary escapement means, if any, are used, this invention facilitates complete adjustment of beater stroke length, from zero to maximum usable on it.

Eyelet bush 20 and tube bush 23, both of which have smoothly surfaced, curvedly finished ends to reduce wear, are connected by means of tension cable 21, thereby forming a triangular coupling between beater cantalever 16 and treadle 4 (see FIG. 1). This distributes force evenly and damps tension cable 21 against oscillation. Typically, those drive openings 18 and secondary escapement openings 19 which are preferred by the operator for frequent use would each contain an eyelet bush 20.

Crimped ferrules 22 are shown as fastening means for tension cable 21; but other suitable means may be used, and excepting opening 17, openings in beater cantalever 16 may take other forms, such as slots, for rapid selection of openings. Also, treadle 24 is shown connected to beater cantalever 16 by means of the flexible member 21; but a rigid member may be similarly applied. The intent of this invention is not solely limited to its preferred embodiment; other means of similar utility, such as continuously variable drive and supplementary escapement means are also within the scope of my invention.

The length of tension cable 21 is adjustable; and treadle 24 is invertible. This facilitates predisposition of treadle 24 angle and a choice of treadle foot-contacting surfaces.

Treadle 24 has a lamination-intrinsic, cast, or sawed-out pattern of fourteen slots 25, extending through its thickness and longitudinally for a greater part of its length. In width, each slot is approximately one-fourtieth of the total width of treadle 24. Slots 25 accrue with respect to total treadle 24 width as follows: from either outside edge, solid 3/40, slot, solid 2/40, slot, solid 1/40, slot, solid 1/40, slot, solid 2/40, slot, solid 1/40, slot, solid 1/40, slot, solid 2/40, portions together comprising 20/40; the remaining half is symmetrical about center. This pattern serves to decrease wind resistance, to afford maximum strength-to-weight and strength-to-area ratios, and to provide integral rigidity, due to the harmonic structure of its total geometry, which is relatively complex and damped against undesirable oscillation under load. This pattern is arranged to support greater loads on critical areas, such as those near outside edges, oddnodes, and center. Heel and toe ends of treadle 24 are preferably formed as radii centered on axii of live axle 26, and tube bush 23, which may be formed integrally.

Treadle 24 is rotatably mounted to frame members 28 by means of live axle 26, which is preferably composed of two parts, a rigid central shaft preferably pressed into a cover for bearing against treadle axle openings 27 in the frame members 28.

Functions of spacers 29 are manifold. With frame washers 30 they separate and hold frame members 28 stationary, and serve as a non-slip base for the entire assembly. Spacer 29 adjacent heel end of treadle 24 serves as a heel and foot rest, and for foot orientation. Spacer 29 adjacent and beneath toe end of treadle 24 prevents tension cable 21 from scraping on frame members 28, and can serve as a treadle movement limit detent.

Spacer 29 near the end of frame members 28 more distant from treadle 24 serves as a pad, and, with the portions of frame members 28 extending from the edges of frame members 32 most distant from frame members 33, forms a stand upon which the drum mounts.

Frame members 28, 32, and 33 are connected in the form of a triangular standard, the longer sides of which extend upwardly to form an apex to which static axle 34 is mounted.

Pithy spacers 35 serve to center beater cantalever 16 between frame members, and can contain and distribute lubricant to the bearing area at opening 17. The top ends of frame members 32 are enlarged to contain the outer sides of pithy spacers 35.

The following description refers to drawing FIGS. 1, 4, and 5.

Cymbals 100 are assembled between felt washers 101 and by fastener means 102 to cymbal clamp frame members 103, which are connected by welds 104 and with pins 105, on which hinge cymbal clamp members 106 or 107.

Cymbal clamp members 106 and 107 are similar, but take their individual form depending on whether they function in a stationary or movable mode. In the stationary mode, cymbal clamp frame members 106 rest against the outside perimeter of drive guide 109, extend outwardly and diametrically beyond pins 105, and constrict to drive guide 109 by a common hose-type clamp. Also, in the stationary mode, tilter members 108, mounted on and to cymbal clamp frame members 103, are used to tilt the cymbal to the desired angle; and additional stationary cymbal clamp assemblies can be used as stops under movable cymbal clamp assemblies for use when the movable cymbal clamps are not connected to drive rod 112. In the movable mode, cymbal clamp members 107 intend through openings 110, and constrict by an elastic band thereagainst and thereby also lock into tab catch 111, which is welded to drive rod 112.

Drive guide 109 is constricted by perforated straps 113, compression washers 114, and fastener means 115;

perforated straps 113 are welded to frame member 116. Therefore, drive guide 109 is rigidly and adjustably mounted to frame member 116.

Drive rod 112 operates vertically in drive guide 109, and openings 110 are located about tab catches 111 so as to allow for movement of cymbal clamp members 107 without interference from drive guide 109, in whichever linear direction is desired.

Rod guide 117, mounted to frame member 116 by fastener means 118, is used to align and direct a lower portion of drive rod 112 with respect to roller or rollers 120 and tension cable 121. Rod guide 117 can be located with shims, washers, or other means toward or away from the center of drive guide 109.

Drive rod opening 119, the ends of which are smoothly surfaced and curvedly finished to reduce wear and which is located near the lower end of drive rod 112, allows for connection, under and/or over roller or rollers 120, depending on the desired direction of cymbal drive, of tension cable 121, which is connected to itself by crimped ferrules 122, with tube bush 123, thereby forming a triangular coupling between the treadle 124 and the drive rod 112 similar to that employed in the drum pedal assembly.

The parts from tension cable 121 consecutively through fastener means 131 inclusive are constructed and function similarly to parts 21 through 31, described earlier, with the following exceptions: treadle 124 is slightly tapered at its toe end to allow rotation of treadle 124 past the edges of frame member 116 and to protect tension cable 121 from scraping against frame member 116 as it nears roller or rollers 120, frame members 128 need not extend away from treadle 124 beyond frame members 133, and fastener means 131 can be of greater length than shown, to allow connection of the structural frames of multiple pedals.

Supplementary escapement means to that inherent in the cymbals pedal assembly when cymbals movably clamped operate as lower cymbals are illustrated in phantom at the top end of drive guide 109. Such means as elastic members, such as a resilient toroid and a resilient disc or two toroids located in a cylinder and above and beneath a piston or plunger disc attached to drive rod 112 can act, against drive rod 112, to remove the movable cymbal in every pair operated from contact with the stationary cymbal in every pair operated, after initiation of an operating cycle. A rod detent frame 134 is welded to the frame member 116 and contains a rod limit detent 135. A rod detent handle 135 locates the rod detent 135 at the desired height to stop downward motion of drive rod 112.

Means of similar utility other than those depicted in the drawing figures, such as quick-disconnect or bayonet-type fastener means, especially the means usable to mount a cymbal to a cymbal clamp, locking movable clamp means which fix to a drive rod by other fastener means such as those of screw-thread variety, speed-valving of supplementary cymbals pedal escapement means, and continuously variable drive rod detent height adjustment means, are also within the scope of my invention.

Rollers 120 mount at openings 132 inside of frame member 116. The use of only one roller 120 is required for operation of the drive rod 112 upwardly when treadle 124 is depressed; however for downward operation, the tension cable 121 is connected under the lower as well as over the upper of both of the two rollers 120.

Frame members 133 and 33 are identical, and dismount at the top for folding of the assembly.

Preferred materials for the components of the invention are: perforated strap 13—fiber, plastic, and or rubber; beater cantalever 16 and eyelet bush 20—beryllium or other alloy; tension cable 21—carburized iron with plastic jacket; ferrules 22—metal alloy; tube bush 23 if formed separately—hard, lightweight material; treadle 24—wood, fiber, plastic, or ceramic, possibly foamed and/or cast; moving axle 26—central shaft of hard, lightweight material, and cover of chrome-iron alloy or bronze; frame members 28, 32, and 33—chrome-iron alloy, fiber, or plastic material; static axle 34—bearing-type plastic or copper alloy; pithy spacers 35—spongy plastic or rubber of low density and high porosity; sides of beater cantalever which are in contact with pithy spacers 35 may be coated with a film—polytetrafluoroethylene; felt washer 101—cotton fiber; spacer 29—rubberized cotton hose over polyethelyne or heavier, more dense material; fastener means 102 and clamp frame members 103—beryllium copper; pin 105—hard metal alloyed with bismuth or antimony for resistance to heat distress; cymbal clamp members 106 and 107—hard metal such as nickel alloy, possibly with chromium and/or titanium; tilter members 108—metal; drive guide 109—beryllium copper; tab catch 111—hard, durable alloy such as tungsten carbide; drive rod 112 —beryllium or other strong, lightweight material to which tab catch 111 can be bonded; perforated strap 113—chrome-iron alloy; frame member 116—chrome-iron alloy preferably hardened with nickel; rod guide 117—bronze; rollers 120—polystyrene or hybrid plastic with beryllium or strong aluminum alloy, various combinations are possible to provide a lightweight, rigid, durable, electrically insulated roller; frame members 128 and 133—see frame members 28 and 33; rod detent frame 134—metal bondable to frame member 116; rod detent 135—rubber; rod detent handle 136—metal; escapement means pictured in phantom—rubber, gas, and metal.

I claim:

1. A drum pedal assembly comprising the following:

a plurality of spacer members, each being substantially cylindrical;

a plurality of frame members, each being substantially flat and symmetrical;

said frame members and said spacer members being connected so as to form a base for the assembly;

a treadle comprising a platform with longitudinal openings therein;

a live axle for pivotably supporting said treadle between at least two of the frame members;

a static axle between two other frame members;

an open-bearing cantilever mounted on said static axle;

a tension cable coupling, employed in a triangular form, for detachably connecting said treadle and said beater cantilever;

a drum beater suspended from said beater cantilever which functions as an inherent escapement means;

secondary escapement means mounted near a top extremity of said drum beater, which is itself comprised of fixture means to locate and tension an elastic band, and an elastic band;

pithy spacers mounted on said static axle on each side of said beater cantilever; and fastening means for holding everything together.

2. A cymbals pedal assembly comprising the following:

a plurality of spacer members, each being substantially cylindrical;

a plurality of frame members, each being substantially flat and symmetrical;

said frame members and said spacer members being connected so as to form a base for the assembly;

a treadle comprising a platform with longitudinal openings therein;

a live axle for pivotably supporting said treadle between at least two frame members;

a tension cable coupling, arrangeable in a triangular form;

at least one roller for enabling transfer of motion of said treadle through said cable to a cymbal drive including;

a drive guide with at least one opening in its side, allowing for intrusion of a member connected to a movable cymbal;

a drive rod with at least one tab catch attached thereto;

a rod guide;

at least one movable cymbal clamp;

at least one stationary cymbal clamp;

supplementary escapement means, mounted near the top of said cymbals pedal; and fastening means for holding the aforesaid together.

3. A combination of elements comprising an assembly of at least one drum pedal and at least one cymbal pedal including:

a plurality of spacer members, each being substantially cylindrical;

a plurality of frame members, each being substantially flat and symmetrical;

said frame members and said spacer members being connected so as to form a base for the assembly;

a treadle comprising a platform with longitudinal openings therein;

a live axle for pivotably supporting said treadle between at least two of the frame members;

a static axle between two other frame members;

an open-bearing beater cantilever mounted on said static axle;

a tension cable coupling, employed in a triangular form, for detachably connecting said treadle and said beater cantilever;

a drum beater suspended from said beater cantilever to function as a primary escapement means;

secondary escapement means mounted near a top extremity of said drum beater, which is itself comprised of fixture means to locate and tension an elastic band, and an elastic band;

pithy spacers mounted on said static axle on each side of said beater cantilever;

a second treadle comprising a platform with longitudinal openings therein;

another live axle for pivotably supporting said second treadle between two additional frame members of said base;

a second tension cable coupling, arrangeable in a triangular form;

at least one roller for enabling transfer of motion of said second treadle through said second cable to a cymbal drive including;

a drive guide with at least one opening in its side, allowing for intrusion of a member connected to a movable cymbal;

a drive rod with at least one tab catch attached thereto;

a rod guide;

at least one movable cymbal clamp;

at least one stationary cymbal clamp;

supplementary escapement means, mounted near the top of said cymbals pedal; and fastening means for holding the aforesaid together.

4. A pedal assembly for use by musicians comprising:

a support base for said assembly having a plurality of parallel frame means and spacer means between said parallel frame means for fastening said parallel frame means together;

actuating means for percussion instruments;

additional parallel frame means mounted on said support base for supporting said actuating means for percussion instruments;

treadle means mounted on said support base; and flexible cable coupling means between said treadle means and said actuating means;

said spacer means being in the form of a plurality of cylindrical bars, each of which has a surface suitable for gripping, and which are usable as base means, and one of which is usable as a heel stop and footrest, and another of which is usuable as a treadle detent, and a further one of which is usable as a pad upon which a drum can rest.

5. A pedal assembly as set forth in claim 4, wherein said actuating means includes a static axle mounted between said additional parallel frame means which supports on a single bearing portion a rotatable cantilever to which a drum beater is suspended.

6. A pedal assembly as set forth in claim 5, wherein said cantilever has a plurality of openings along two edges thereof which provide for primary and secondary adjustment of the mechanical advantage relationships of appurtenances to said cantilever by inversion of said cantilever on the rotational axis thereof, and by means of a change in the location of an appurtenance in relation to the location of said openings.

7. A pedal assembly as set forth in claim 5, wherein gravity provides an inherent escapement of said drum beater having a head of sufficient mass because of the suspension of the head of said drum beater beneath said cantilever so as to be adjacent the center of a drumhead.

8. A pedal assembly as set forth in claim 5, wherein said cantilever suspends by clamp means the head of said drum beater, said head being of sufficient mass beneath the static axle on which said cantilever is rotatably mounted on said single bearing portion, and thus said cantilever being normally operable on only one bearing portion on said static axle.

9. A pedal assembly as set forth in claim 8, wherein said clamp means includes a perforated strap which constricts around a rod supporting said drum beater head using fastener means carried by said perforated strap and said cantilever.

10. A pedal assembly as set forth in claim 8, wherein a pair of pithy spacers are used to center said beater cantilever on its axle, and which contain and distribute lubricant to said bearing portion of said drum pedal cantilever.

11. A pedal assembly as set forth in claim 8, wherein said treadle means includes an elongated platform having means therein for reducing wind resistance, and which is formed so as to be fully and normally operable after having been removed from its mounting and disconnected, inverted, and re-mounted and re-connected.

12. A pedal assembly as set forth in claim 11, wherein said means for reducing wind resistance includes said platform having fourteen slot openings extending longitudinally for a greater part of its length.

13. A pedal assembly for use by musicians comprising:

a support base for said assembly having a plurality of parallel frame means and spacer means between said parallel frame means for fastening said parallel frame means together;

actuating means for percussion instruments;

additional parallel frame means mounted on said support base for supporting said actuating means for percussion instruments;

treadle means mounted on said support base; and flexible cable coupling means between said treadle means and said actuating means;

said treadle means including an elongated platform having means therethrough for reducing wind resistance, and which is symetrically formed so as to be fully and normally operable after having been removed from its mounting and disconnected, inverted, and re-mounted and re-connected.

14. A pedal assembly as set forth in claim 13, wherein said coupling means includes a tension cable or wire, employed, in a triangular coupling form, as functional means to connect said treadle to said actuating means, for the purpose of transferring motion.

15. A pedal assembly for use by musicians comprising:

a support base for said assembly having a plurality of parallel frame means and spacer means between said parallel frame means for fastening said parallel frame means together;

actuating means for percussion instruments;

additional parallel frame means mounted on said support base for supporting said actuating means for percussion instruments;

treadle means mounted on said support base; and flexible cable coupling means between said treadle means and said actuating means;

said additional frame means including at least two structural frame members in which halves, adjacent and extending from all longitudnal central axis planes of each member, are fully symmetrical, and said structural frame members are provided in the form of a triangular standard to support drive parts of said assembly.

16. A pedal assembly for use by musicians comprising:

a support base for said assembly having a plurality of parallel frame means and spacer means between said parallel frame means for fastening said parallel frame means together;

actuating means for percussion instruments;

additional parallel frame means mounted on said support base for supporting said actuating means for percussion instruments;

treadle means mounted on said support base; and flexible cable coupling means between said treadle means and said actuating means;

said actuating means including structure which can be used to operate and close at least a pair of cymbals together upwardly and downwardly;

said structure including a roller which can be used as means to direct the transference of motion of said flexible coupling means between said treadle means and said actuating means; and said actuating means having a drive rod.

17. A pedal assembly for use by musicians comprising:

a support base for said assembly having a plurality of parallel frame means and spacer means between said parallel frame means for fastening said parallel frame means together;

actuating means for percussion instruments;

additional parallel frame means mounted on said support base for supporting said actuating means for percussion instruments;

treadle means mounted on said support base; and flexible cable coupling means between said treadle means and said actuating means;

said actuating means including structure which can be used to operate and close at least a pair of cymbals together upwardly and downwardly;

said structure including a drive guide which has an opening which extends lengthwise, to allow connection of a cymbal clamp to a drive rod, and to allow linear motion of said drive rod to be transferred outside of said drive guide other than only at or near its ends; and a drive rod detent which is usable to stop downward motion of said drive rod, and which can be adjusted to stop same at various heights.

* * * * *